US007069064B2

(12) United States Patent
Gevorgian et al.

(10) Patent No.: US 7,069,064 B2
(45) Date of Patent: Jun. 27, 2006

(54) TUNABLE FERROELECTRIC RESONATOR ARRANGEMENT

(75) Inventors: Spartak Gevorgian, Göteborg (SE); Anatoly Deleniv, Göteborg (SE); Orest Vendik, St. Petersburg (RU); Erik Kollberg, Lindome (SE); Erland Wikborg, Danderyd (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 10/781,930

(22) Filed: Feb. 20, 2004

(65) Prior Publication Data

US 2004/0183622 A1 Sep. 23, 2004

Related U.S. Application Data

(63) Continuation of application No. PCT/SE02/01461, filed on Aug. 16, 2002.

(30) Foreign Application Priority Data

Aug. 22, 2001 (SE) ..... 0102785

(51) Int. Cl.
*H01P 7/08* (2006.01)
*H01B 12/02* (2006.01)

(52) U.S. Cl. ..... 505/210; 333/99 S; 333/235

(58) Field of Classification Search ..... 333/99 S, 333/205, 204, 219, 235; 505/210, 700, 701, 505/866

See application file for complete search history.

(56) References Cited

U.S. PATENT DOCUMENTS 5,831,279 A 11/1998 Wikborg et al.
5,914,296 A 6/1999 Shen
5,969,584 A * 10/1999 Huang et al. ..... 333/202
6,111,485 A 8/2000 Wikborg et al.
6,114,758 A 9/2000 Anderson et al.
6,114,931 A 9/2000 Wikborg et al.
6,185,441 B1 2/2001 Wikborg et al.
6,187,717 B1 2/2001 Wikborg et al.
6,188,236 B1 2/2001 Wikborg et al.
6,344,659 B1 2/2002 Wikborg et al.

(Continued)

FOREIGN PATENT DOCUMENTS

WO 96/42118 A1 12/1996

OTHER PUBLICATIONS

Electronics Letters, vol. 37, No. 17, Aug. 2001, P.K. Petrove et al; "Tunable Dielectric Resonator with Ferroelectric Element"; pp. 1066-1067.

(Continued)

*Primary Examiner*—Benny T. Lee
(74) *Attorney, Agent, or Firm*—Nixon & Vanderhye, P.C.

(57) ABSTRACT

The present invention relates to a tunable resonating arrangement comprising a resonator apparatus (10), input/output coupling (4) means for coupling electromagnetic energy into/out of the resonator apparatus, and a tuning device (3) for application of a biasing voltage/electric field to the resonator apparatus. The resonator apparatus comprises a first resonator (1) and a second resonator (2). Said first resonator is non-tunable and said second resonator is tunable and comprises a ferroelectric substrate (21). Said first and second resonators are separated by a ground plane (13) which is common for said first and second resonators, and coupling means (5) are provided for providing coupling between said first and second resonators. For tuning of the resonator apparatus, the biasing voltage/electric field is applied to the second resonator (2).

29 Claims, 10 Drawing Sheets

U.S. PATENT DOCUMENTS

| | | | | |
|---|---|---|---|---|
| 6,433,375 | B1 | 8/2002 | Wikborg et al. | |
| 6,463,308 | B1 * | 10/2002 | Wikborg et al. | 505/210 |
| 6,479,139 | B1 | 11/2002 | Wikborg et al. | |
| 6,501,972 | B1 | 12/2002 | Wikborg et al. | |
| 6,504,469 | B1 | 1/2003 | Wikborg et al. | |
| 6,556,849 | B1 | 4/2003 | Wikborg et al. | |
| 6,563,153 | B1 | 5/2003 | Wikborg et al. | |
| 2001/0054748 | A1 | 12/2001 | Wikborg et al. | |
| 2002/0044027 | A1 | 4/2002 | Wikborg et al. | |
| 2004/0150493 | A1 | 8/2004 | Wikborg et al. | |

OTHER PUBLICATIONS

IEEE Transactions on Applied Superconductivity, vol. 7, No. 2, Jun. 1997, Gevorgian et al.; "HTS/Ferroelectric Devices for Microwave Applications"; pp. 2458-2461.

* cited by examiner $TM_{010}$ $TM_{110}$ $TM_{210}$ $TM_{020}$ $TM_{310}$ $TM_{410}$

TUNABLE FERROELECTRIC RESONATOR ARRANGEMENT

This application is a continuation of PCT International Application No. PCT/SE02/01461, filed in English on 16 Aug. 2002, which designated the US. PCT/SE02/01461 claims priority to SE Application No. 0102785-3 filed 22 Aug. 2001. The entire contents of these applications are incorporated herein by reference.

FIELD OF THE INVENTION

The present invention relates to a tunable resonating arrangement which comprises a resonator apparatus. Electromagnetic energy is coupled into/out of the resonator apparatus over input/output coupling means, and for tuning of the resonator apparatus, a tuning device is used for application of a biasing/tuning voltage (electric field) to the resonator apparatus. The invention also relates to such a resonator apparatus, a tunable filter arrangement, and to a method of tuning a resonating arrangement.

STATE OF THE ART

Electrically tunable resonators are attractive components for agile radar and mobile radio communication systems. Different types of resonators are known. Dielectric and parallel plate resonator and filters for microwave frequencies using dielectric disks of any shape, for example circular, are known for example, from Vendik et al., Electronics Letters vol. 31, p. 654, 1995, which herewith is incorporated herein by reference.

Parallell plate resonators comprising substrates of non-linear dielectric materials with extremely high dielectric constants, for example ferroelectric materials or anti-ferroelectric materials, have small dimensions, and they can for example be used to provide very compact filters in the frequency bands in which advanced microwave communication systems operate. Such non-linear dielectric materials may e.g. be STO($SrTiO_3$) with a dielectric constant of about 2000 at the temperature of liquid nitrogen and a dielectric constant of about 300 at room temperature.

Dielectric, parallel plate resonators can be excited by simple probes or loops. For the majority of practical implementations the thickness of a parallell plate resonator is much smaller than the wavelength of the microwave signal in the resonator in order for the resonator to support only the lowest order TM modes and in order to keep the DC-voltages, which are required for the electrical tuning of the resonator comprising a dielectric substrate with electrodes arranged on both sides of it, as low as possible. For such resonators electrical tuning is obtained by means of the application of an external DC-biasing voltage, which is supplied by means of ohmic contacts to the electrodes acting as plates of the resonator. Tunable resovators based on thin film substrates as well as resonators based on dielectric bullc substrates are known. A resonator is considered to be electrically thin if the thickness is smaller than half the wavelength of the microwave signal in the resonator such that no standing waves will be present along the axis of the disk. Electrically tunable resonators based on circular ferroelectric disks have recently been found attractive and have drawn much attention, for example, for applications as tunable filters in microwave communication systems, as well as in mobile radio communication systems.

Such devices are for example described in "Tunable Microwave Devices", which is a Swedish patent application with application number 9502137-4 and corresponding U.S. Pat. No. 6,463,308; and, "Arrangement and method relating to tunable devices" which is a Swedish patent application with application number 9502138-2 and corresponding U.S. Pat. No. 6,187,717 which herewith are incorporated herein by reference.

Substrates comprising ferroelectric materials in resonators and filters are of interest for different reasons. Among other things ferroelectric materials are able to handle high peak power, they have a low switching time, and the dielectric constant of the substrate varies with an applied biasing voltage, which makes the impedance of the device vary with an applied biasing electric field. For example U.S. Pat. No. 5,908,811, "High Tc Superconducting Ferroelectric Tunable Filters", shows an example of such a filter which should get low losses by means of using a single crystal ferroelectric material. A ferroelectric thin film substrate is used. However, this device as well as other resonators and filters based on ferroelectric materials suffer from the drawback of the quality factor (Q-value) of the ferroelectric substrate or element decreasing drastically with the applied voltage, when a biasing voltage is applied. This has recently been established by A. Tagantsev in "DC-Electric-Field-induced microwave loss in ferroelectrics and intrinsic limitation for the quality factor of a tunable component", Applied Physics Letters, Vol. 76, No. 9, Feb. 28, 2000, p. 1182–84, to be a consequence of a fundamental loss mechanism (called quasi-Debye Effect) induced in the ferroelectric material by the applied biasing field. However, so far, no satisfactory solution to the problem associated with induced losses in tunable ferroelectric resonators has been found.

SUMMARY OF THE INVENTION

What is needed is therefore a tunable resonating arrangement, more particularly for microwaves or millimeter waves, which has small dimensions and which can be used in different kinds of advanced microwave communication systems and mobile radio communication systems. A tunable resonator arrangement is also needed which has a high, or at least satisfactory, performance, and which is easy to fabricate. Particularly a tunable resonating arrangement is needed through which it is possible to compensate for the losses in a ferroelectric substrate upon application of an electric field/voltage for tuning purposes. Particularly an arrangement is needed which has a high power handling capability. Even more particularly an arrangement is needed through which tuning by the means of the application of a DC-biasing can be provided substantially without deteriorating. the quality factor (Q-value) of the resonator.

An arrangement is also needed which is compact in size for use in different types of components, which can be tuned efficiently without requiring too high amounts of power, and which is reliable in operation. Moreover an arrangement is needed which is robust and which has a satisfactory tuning selectivity and tuning sensitivity, and through which the insertion losses are low or can be compensated for.

A tunable filter arrangement is also needed which comprises one a more resonator apparatuses and which meets one or more of the objects referred to above. Still further a method of tuning a resonator arrangement is needed through which the above mentioned objects can be achieved, and particularly a method of compensating for the losses induced in a ferroelectric resonator substrate through electrical or electronical tuning.

Therefore a tunable resonating arrangement is provided which comprises a resonator apparatus, input/output coupling means for coupling electromagnetic energy into/out of the resonator apparatus, and a tuning device for application of a biasing voltage/electric field to the resonator apparatus. The resonator apparatus comprises a first resonator and a second resonator. The first resonator is a non-tunable high quality resonator (i.e. having a high Q-factor), and the second resonator is a tunable resonator comprising a ferroelectric substrate. The first and second resonators are separated by a ground plane which, however, is common for, i.e. shared by, said first and second resonators, and coupling means are provided for providing coupling between said first and second resonators. For tuning of the resonator arrangement, a tuning voltage/electric field is applied to the second resonator. Advantageously the first resonator is a disk resonator, or a parallell plate resonator, and the second resonator is another disk resonator or a parallell plate resonator. Advantageously the first resonator comprises a dielectric substrate, the electric permittivity of which does not, or substantially not, vary with applied voltage, which dielectric substrate is disposed between a first and a second electrode plate, of which electrodes the second electrode forms the ground plane.

The second resonator preferably comprises a tunable ferroelectric substrate and a first and a second electrode plate. The second electrode plate forms the common ground plane and thus is common with, or the same as, the second electrode of the first resonator, which means that the two resonators share an electrode plate which forms the ground plane for both of said resonators.

The dielectric substrate of the first resonator may for example comprised $LaAlO_3$, MgO, $NdGaO_3$, $Al_2O_3$, sapphire or a material with similar properties. Particularly the quality factor (Q-value) of the first resonator may exceed approximately $10^5$–$5 \cdot 10^5$.

The substrate of the second resonator may for example comprise $SrTiO_3$, $KTaO_3$, or $BaSTO_3$.

The first and second electrodes of each resonator, which here means the first electrodes and the common ground plane, in one implementation consist of normal conducting metal, such as for example Au, Ag, Cu. In another implementation the first and second electrodes, i.e. the first electrodes and the common ground plane, consist of a superconducting material. Even more particularly the first and second electrodes, i.e. the first electrodes and the common ground plane, consist of a high temperature superconducting material (HTS), for example YBCO (Y—Ba—Cu—O). Other alternatives are TBCCO and BSCCO. In a particular implementation superconductors or superconducting films (HTS) are used, which may be covered by thin non-superconducting high conductivity films of for example Au, Ag, Cu or similar. Such devices are also discussed in "Tunable Microwave Devices" which was incorporated herein by reference. Particularly the first and second resonators are TM0.20 mode resonators. However, also other modes can be selected, as discussed example in the Swedish patent application "Microwave Devices and Method Relating Thereto" with application number 9901190-0, which herewith is incorporated herein by reference, and which illustrates how different modes can be selected, and which gives example on which mode(s) that can be selected, for exemplifying reasons.

Through the application of a tuning (biasing) voltage to said second resonator, electromagnetic energy will be distributed to the first resonator and, particularly, as the biasing voltage increases, more and more electromagnetic energy will be distributed or transferred to the first resonator since the resonators are coupled the way they are. This means that the distribution of electromagnetic energy between the first and second resonators depends on the biasing (tuning) voltage or the electric field and of course the coupling means. The resonating frequency in the second resonator increases with the application of an increasing biasing voltage. As the biasing voltage increases, also the loss tangent of the second, ferroelectric, resonator will increase, at the same time as less of the electromagnetic energy will be located in it. Thereby will automatically be compensated for the increased loss tangent of the second resonator in that the influence thereof on the coupled resonator apparatus comprising the first and the second resonators will be reduced.

Particularly the first and second resonators comprise disk resonators based on a dielectric/ferroelectric bulk material. They may however also comprise thin film substrates. However, by using tunable disk resonators resonating arrangements, particularly filters, which have a much higher power handling capability than those made of tunable thin film, can be realized.

Particularly the resonating arrangement comprises at least two resonator apparatuses, and the common ground plane is common for (shared by) the at least two resonator apparatuses to form a tunable filter.

According to the invention, for coupling a first and a second resonator to each other, the coupling means may comprise, for each resonator apparatus, a slot or an aperture in the common ground plane. The resonators may be of substantially any appropriate shape, they may e.g. be circular, square-shaped, rectangular or ellipsoidal etc. The shape of the first resonator may also differ from that of the second resonator. The resonator apparatus may also be a dual mode resonator apparatus. Then each resonator comprises mode coupling means such as for example a protrusion, a cut-out or any other means to provide for dual mode operation. Examples thereon are provided in the patent applications incorporated herein by reference. According to the invention it can be said that tunability and losses is exchanged or distributed between the two resonators of a resonator apparatus, thereby reducing the effect of the induced increasing losses caused by the electrical tuning.

According to the invention thus a tunable resonator apparatus is provided which comprises a first resonator and a second resonator, wherein in said first resonator is non tunable, said second resonator is tunable and ferroelectric, i.e. comprises a ferroelectric substrate, whereby said first and second resonators are separated by a ground plane which is common for said first and second resonators. Coupling means are provided for providing coupling between said first and second resonators, and for tuning of the resonator apparatus, a tuning voltage is applied to the second resonator. Particularly the first and the second resonator comprises disk resonators or parallell plate resonators, and the common ground plane is formed by a second electrode plate of the first resonator which is common with a second electrode plate of the second resonator. The coupling means particularly comprises a slot or an aperture or similar in the common ground plane, through which electromagnetic energy can be transferred from one of the resonators to the other.

The invention also discloses a method of tuning a resonator arrangement which comprises the steps of; providing a first, non-tunable resonator; providing a second tunable resonator, such that the first and second resonators are separated by a common ground plane; providing a coupling means in said common ground plane such that the first and second resonators become coupled for transfer of electromagnetic energy between the first and second resonators; changing the resonant frequency thereof by application of a biasing/tuning voltage/electric field to said second resonator, both increasing the resonant frequency, the loss tangent of the second resonator and the redistribution of electromagnetic energy to the first resonator; optimizing the application of a biasing voltage/electric field such that the influence of the increased loss tangent in the second resonator on the coupled resonator apparatus will be compensated for by a higher transfer of electromagnetic energy to the first resonator. Particularly the resonator apparatus discloses one or more of the features mentioned above.

BRIEF DESCRIPTION OF THE DRAWINGS

The invention will in the following be further described in a non-limiting manner and with reference to the accompanying drawings, in which.

DETAILED DESCRIPTION OF THE INVENTION

FIGS. 1A–1F disclose, for illustrative purposes, the lower order $TM_{nmp}$ field distributions for a circular parallell plate resonator, i.e. the $TM_{010}$, $TM_{110}$, $TM_{210}$, $TM_{020}$, $TM_{310}$, $TM_{410}$-modes. Solid lines indicate the current, dashed lines indicate the magnetic field and dots and crosses indicate the electric field. It is supposed that p=0, i.e. that the thickness of the substrate is smaller than half a wavelength in the resonator, and that the resonator only supports $TM_{nm0}$-modes. The field/current distributions are fixed in space by coupling arrangements (such as coupling loops, coupling probes, or a further resonator).

Parallel plate resonators, for example in the form of circular dielectric disks and circular patches on dielectric substrates, have found several different microwave applications. The resonators are seen as electrically thin if the thickness (d) is smaller than half the wavelength of the microwave ($\lambda_g$) in the resonator, $d<\lambda_g/2$, so that no standing waves will be present along the axis of the disk. Electrically tunable resonators based on circular ferroelectric disks have been largely investigated for applications in tunable filters. A simplified electrodynamic analysis of a parallel plate resonator proposes a simple formula for the resonant frequency:

$$f_{nm0} = \frac{c_0 k_{nm}}{2\pi r\sqrt{\varepsilon}}$$

e where $c_0=3\times10^8$ m/s is the velocity of light in vacuum, $\in$ is the relative dielectric constant of the disk/substrate, r is the radius of the conducting plate, and $k_{mm}$ are the roots of Bessel functions with mode indexes n and m. For an electrically thin parallel-plate resonator the third index is 0. The above formula may be corrected taking fringing fields into account.

Particularly attractive for filter applications are for example the axially symmetric modes with plate currents only in the radial direction. These modes are characterized by higher quality factors (Q) since they do not have any surface currents along the edges of the conductor plates.

In a particularly advantageous implementation of the present invention, the mode selected for the resonators is the $TM_{020}$ mode. The invention is however not limited to any particular mode but substantially any mode could be selected. Mode selection is among others discussed in "Microwave Device and Method Relating Thereto" with U.S. Pat. No. 6,501,972 as discussed earlier in the application.

Figure 1A:
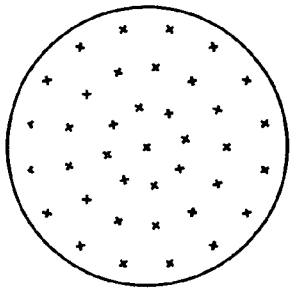
FIGS. 1A–1F for illustrative purposes show the current lines (field distributions) for a number of different TM modes of a circular, parallell plate resonator, FIG. 2 particularly illustrates a state of the art resonator having a field distribution as in FIG. 1A.
Figure 1B:
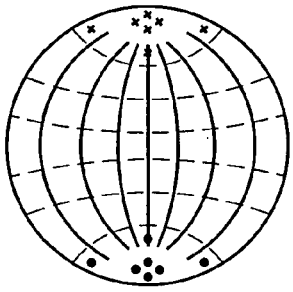
Figure 1C:
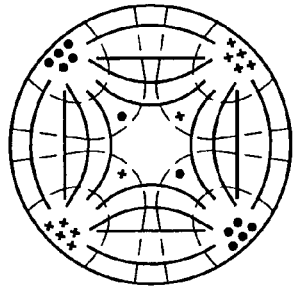
Figure 1D:
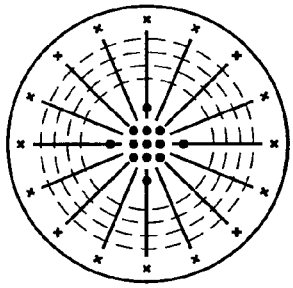
Figure 1E:
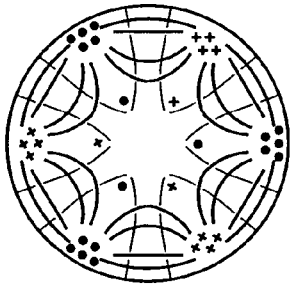
Figure 1F:
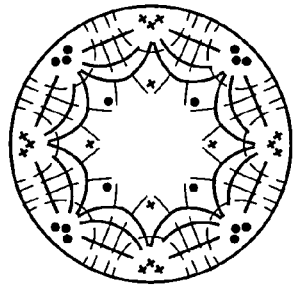
Figure 2:
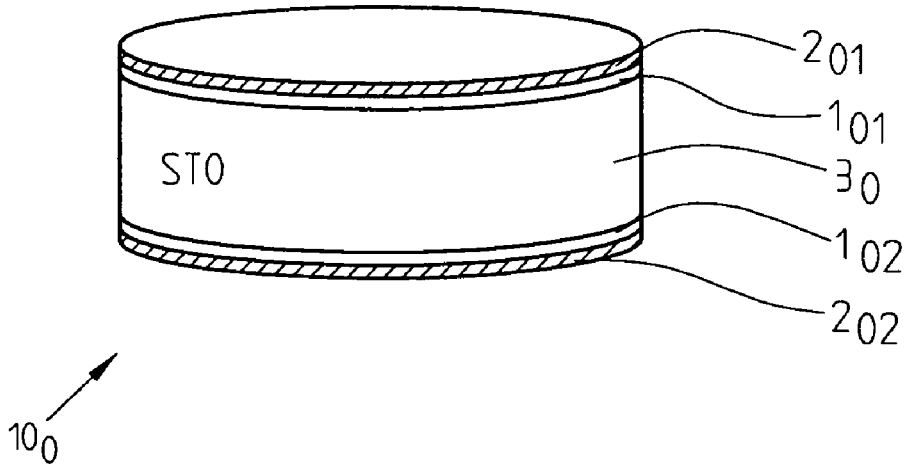

FIG. 2 schematically illustrates an electronically tunable resonator $\mathbf{10}_0$ based on a non-linear dielectric substrate $\mathbf{3}_0$ with an extremely high dielectric constant, e.g. STO ($SrTiO_3$) which has a dielectric constant of more than 2000 at the temperature of liquid nitrogen (N) and a dielectric constant of about 300 at room temperature. On both sides of the substrate high temperature superconductors $\mathbf{1}_{01}$, $\mathbf{1}_{02}$, e.g. of YBCO, are respectively provided which in turn, in this embodiment, are covered by thin non-superconducting, high conductivity films $\mathbf{2}_{01}$, $\mathbf{2}_{02}$ of e.g. Au. As an example the resonant frequencies of a circular parallel plate disk resonator having a diameter of 10 mm and a thickness of 0.5 mm will be in the range of 0.2–2.0 GHz depending on the temperature and on the applied DC biasing. Such resonators can be excited by simple probes or loops as in/out coupling means. In most practical cases the thickness of a parallel plate resonator is much smaller than the wavelength of the microwave signal in order for the resonator to support only the lowest order TM-modes, and in order to keep the DC-voltages, which are required for the electrical tuning of the resonator with a non-linear dielectric substrate as low as possible. The field distribution of such a resonator was shown in FIG. 1A above, for the $TM_{010}$ mode, and in FIG. 1D for the $TM_{020}$ mode, respectively.

Figure 3:
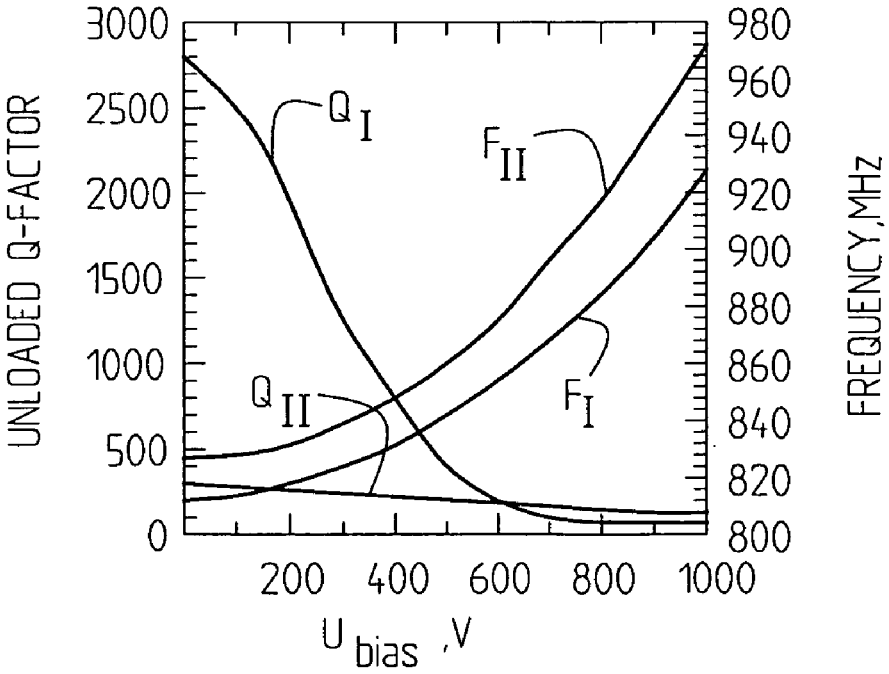
FIG. 3 shows the measured microwave performance of the resonator in FIG. 2.

FIG. 3 schematically illustrates a diagram indicating the measured microwave performance of two resonators. In the figure the unloaded quality factor, Q, as a function of the biasing voltage, is illustrated for a resonator in which normally conducting, i.e. non-superconducting, electrode plates are used, corresponding to $Q_{II}$, and for a resonator in which HTS electrodes of YBCO are used, corresponding to lines $Q_I$. Correspondingly the resonant frequencies are illustrated as a function of the applied biasing voltage, corresponding to $F_I$, $F_{II}$ for Cu electrodes and for YBCO electrodes respectively. It can be seen that at high biasing voltages, it does not make much difference whether YBCO electrodes are used or if normally conducting (non-superconducting) electrode are used.

Advantageously the resonant frequency of a such resonator should be between 0.5–3 GHz, which is the frequency region of cellular communication systems. Thus, the problem of the Q—values of the ferroelectric elements, or non-linear dielectric materials, as discussed above, decreasing drastically with the applied electric field, according to the invention is solved by means of a resonator apparatus comprising two coupled resonators, e.g. as described in FIG. 4, to provide for a so called loss compensation.

Figure 4:
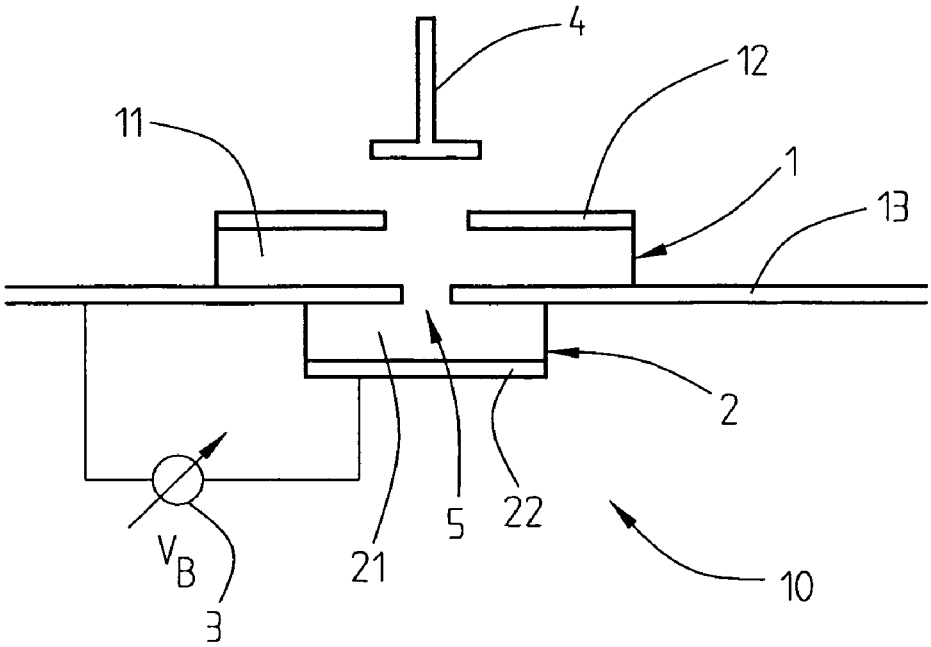
FIG. 4 illustrates a cross-sectional view of a first embodiment of a resonator apparatus according the present invention.

Thus, in FIG. 4, a first embodiment of the present invention is illustrated. It shows a resonator arrangement 10 comprising a resonator apparatus with a first resonator 1 and a second resonator 2 Resonators 1 and 2 are coupled to each other. The first resonator comprises a circular disk resonator with a first electrode plate 12, and a linear substrate 11 with a high quality factor (Q) which is not tunable. The substrate material may for example comprise sapphire, $LaAlO_3$ or any of the other materials referred to earlier in the application. The first resonator 1 comprises another electrode plate 13 disposed on the other side of the linear substrate. The electrodes 12, 13 may comprise a "normally" conducting (i.e. non-superconducting, but preferably high conductivity) metal, such as for example Au, Ag, Cu but they may also comprise a superconducting material. In a particularly advantageous implementation the electrode plates 12, 13 comprise a high temperature superconducting material, e.g. YBCO.

The resonator apparatus 10 further comprises a second resonator 2, which is tunable and comprises a substrate material 21 of e.g. a ferroelectric material, e.g. $SrTiO_3$, $KTaO_3$ or any other of the materials as referred to earlier in the application having a growing loss factor, i.e. for which the quality factor decreases with the applied voltage as discussed above with reference to FIG. 3. Also the second resonator 2 is a circular disk resonator with a first electrode plate 22 and a second electrode plate 13, which is the same electrode plate as the second electrode of the first resonator 1.

Thus the common electrode 13 forms a common ground plane for the first and second resonators 1,2. The first and second resonators 1,2 are coupled to each other through coupling means 5, here comprising a slot or an aperture in the common ground plane 13 allowing for distributing of electromagnetic energy between the two resonators upon application of a biasing voltage ($V_B$). For application of the biasing voltage, biasing means 3 are provided comprising a variable voltage source which is connected to the ground plane 13 and to the first electrode 21 of the second resonator 2, such that for tuning of the resonator apparatus, the biasing voltage is applied to the second resonator 2. When the biasing voltage $V_B$ is applied and increased, the resonant frequency of the second resonator 2 will increase. Electromagnetic energy will then be relocated to the first resonator 1, which means that the increased loss tangent of the second resonator, which, as discussed above, increases as the biasing voltage is increased, will have a low influence on the resonator apparatus as such. Thus, as the biasing voltage increases, more and more electromagnetic energy will be transferred or redistributed to the first resonator 1. In this manner the increased loss in the tunable second resonator 2 will be compensated.

Preferably the coupling slot is circular; which shape it should have depends on the mode(s) that is/are selected. Generally the current lines (cf. FIGS. 1A–1F) should not be interrupted. Normally it functions with a circular slot for all modes. It may also be ellipsoidal. For a rectangular resonator it may be rectangular.

The first and second resonators may also have other shapes, the same or different. The ground plane may also have the same size (and shape) as the first resonator or any other shape as long as it is not smaller than the first resonator.

In the figure input coupling means 4 in the form of an antenna are shown for input of microwave signals to the microwave device for exciting the relevant mode or modes. In principle any input/output coupling means can be used and the antenna is merely indicated for indication of an example of input coupling means. Different types of input/output coupling means are discussed in the Swedish patent application "Arrangement and Method Relating to Microwave Devices" filed on Apr. 18, 1997 with the application No. 9701450-0 and corresponding U.S. Pat. No. 6,185,441 and the content of which herewith are incorporated herein by reference. In this document it is among other illustrated how the coupling means can be used for application of a biasing voltage. It also illustrates examples on coupling means that can be used while still requiring separate biasing means, as well as a number of state of the art devices. The present invention is not limited to any particular way of coupling microwave energy into/out of the device, the main thing being that the biasing voltage is applied to the second resonator, which is tunable, and which is coupled to another resonator which is not tunable, which resonators are coupled to one another such that redistribution of electromagnetic energy is enabled.

One example of a second resonator that can be used in a resonator apparatus according to the present invention was disclosed in FIG. 3. The second resonator 2 may also be a thin parallell plate microwave resonator, thin here meaning that it is thin in comparison with the wavelength in the resonator, $\lambda_g$, more specifically $d<\lambda_g/2$, wherein d is the thickness of the resonator 2, and $\lambda_g$ is the wavelength in the resonator. (Generally the apparatus could be a thin film device, although bulk substrate devices are preferred, as discussed earlier.)

Figure 5:
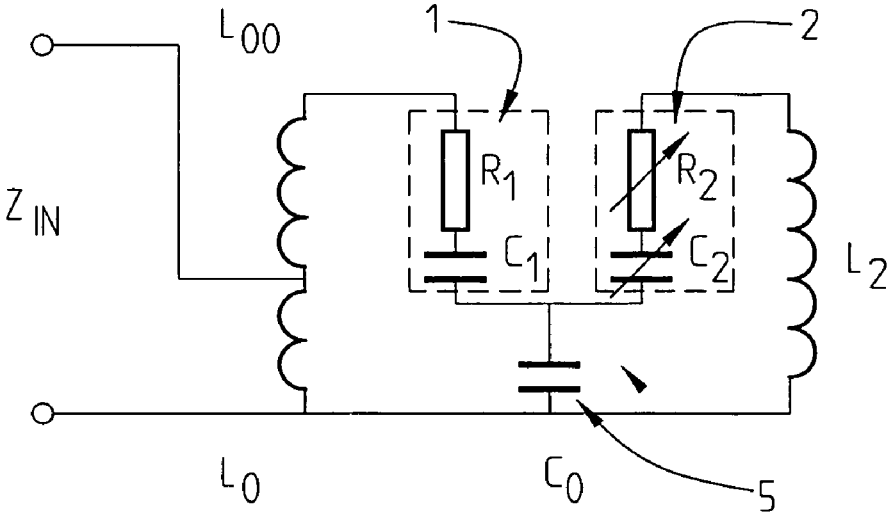
FIG. 5 illustrates the equivalent circuit of the two coupled resonators of the resonator apparatus in FIG. 4.

In FIG. 5 the equivalent circuit of the two coupled resonators 1,2 of FIG. 4 is illustrated. $Z_{in}$ represents the input impedance of the arrangement $R_1$, $C_1$ represent the reactance and the capacitor of the first, non-tunable resonator 1. $R_2$, $C_2$ represent the tunable components of the second resonator 2, and $C_0$5 is the coupling capacitor coupling the first and second resonators to each other.

With reference to FIGS. 6A,6B,7A,7B,7C follows an illustration and explanation of a simulation of the input impedance of the equivalent circuit of FIG. 5. It is here supposed that $d_1$ is the loss factor of the linear dielectric substrate of the first resonator and $d_2(U)$ is the loss factor of the non-linear ferroelectric substrate of the second resonator as a function of the biasing voltage. The biasing voltage V is given in Volts, L (the inductance) in nH. $U_0$ and k are phenomenological characteristics of the ferroelectric material. The simulations are done for three different biasing voltages, namely for V=0, 100, 200V and U0=200V. It is further supposed that C1=2.5 pF, C20=120 pF, and $C_0$=200 pF. L=1.59×$10^{-9}$, m=0.115, L2=0,0517×$10^{-9}$ H, d20=3×$10^{-4}$ and k=30, LO=L×m and L00=L×(1−m).

$$C2(U)=C20/(1+(U/U0)^2) \text{ and } d2(U)=d20(1+k\cdot(U/U0)^2).$$

Figure 6A:
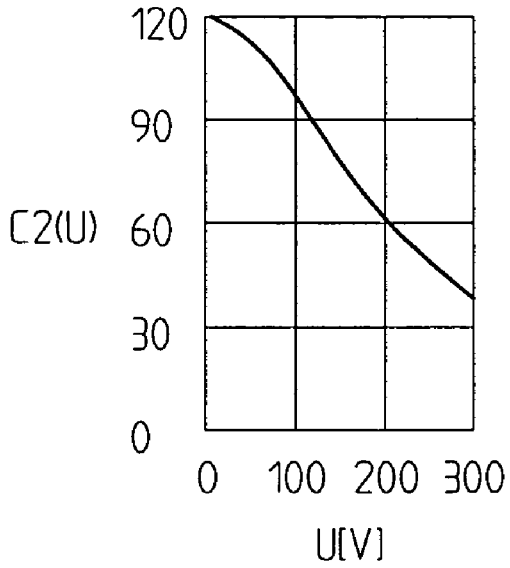
FIG. 6A is a diagram illustrating a dependence of the capacitance of the resonator as a function of the biasing voltage, FIG. 6B diagram illustrating the loss factor as function of biasing voltage.
Figure 6B:
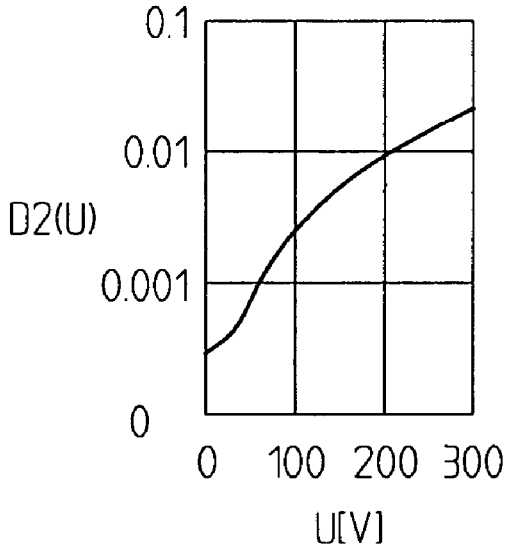

FIG. 6A illustrates the dependence of C2(U) on the applied voltage U and FIG. 6B illustrates the dependence of d2(U) on the applied biasing voltage. The input impedance of the first resonator is given by:

$$Z1(f)=i\omega(f)\cdot L00+\frac{10^{12}}{i\omega(f)\cdot C1}(1+i\cdot d1)$$

and the input impedance of the second resonator is given by:

$$Z2(f,U)=i\cdot\omega(f)\cdot L2+\frac{10^{12}}{i\omega(f)\cdot C2(U)}(1+i\cdot d2(U))$$

Thus the input impedance of the equivalent circuit will be:

$$Z(f,U)=\left[\frac{1}{i\omega(f)L0}+\frac{1}{Z1(f)+[i\omega(f)\cdot C10^{-12}+Z2(f,U)^{(-1)}]^{-1}}\right]^{-1}$$

Figure 7A:
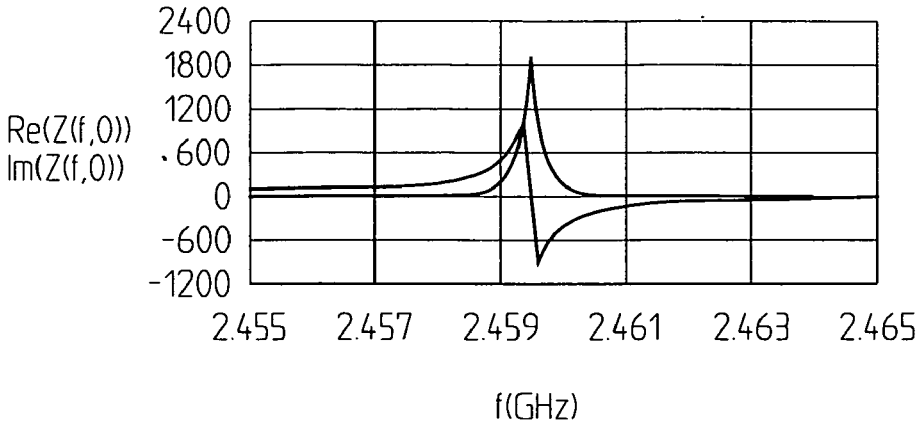
FIGS. 7A–7C show simulated results of the dependence of the input impedances, of the equivalent circuit, on biasing voltage, FIG. 8A schematically illustrates one example of a first resonator that can be used in the resonator apparatus of FIG. 4, FIG. 8B schematically illustrates an example of a resonator that can be used as a second resonator in the resonator apparatus of FIG. 4.
Figure 7B:
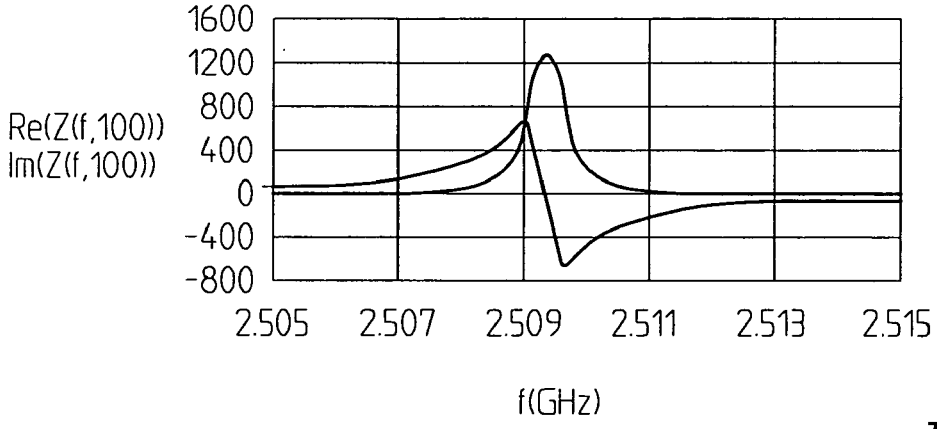
Figure 7C:
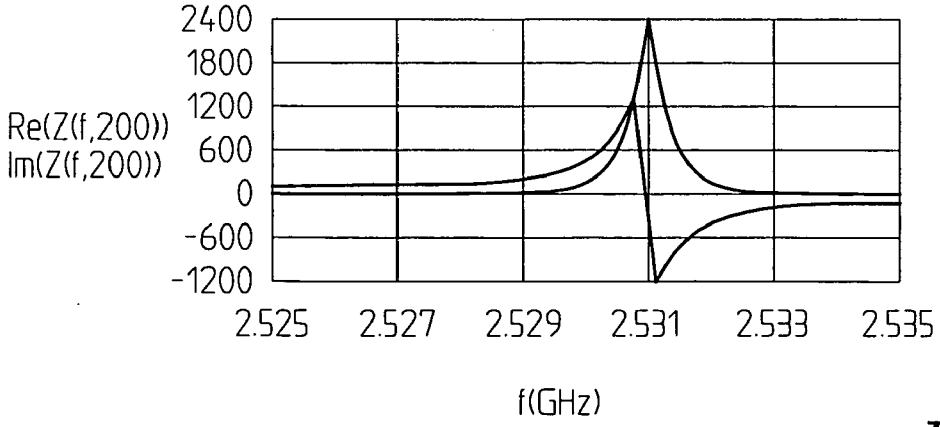

FIGS. 7A illustrate the real and imaginary parts of the input impedance at zero applied voltage. Correspondingly FIGS. 7B, 7C illustrates the real and imaginary parts of the impedance at a biasing voltage of 100V and 200V respectively. As understood by those skilled in the art, the real part is always positive, whereas the imaginary part is positive as well as negative. As can be seen from FIGS. 7A–7C, for zero biasing voltage (FIG. 7A) the resonant frequency will be about 2459.4 MHz, for a biasing voltage of 100V (FIG. 7B) it will be 2509.3 MHz and for an applied biasing voltage of 200V (FIG. 7C) it will be about 2530.9 MHz. The frequency shift ΔF will be 49.9 MHz for 100V and 71.5 MHz for 200 V biasing voltage. In the given range of the applied voltage, the loss factor of the ferroelectric, tunable substrate material will change about 30 times. However, the total quality factor change will be no more than about ±30%. If the frequency band of the resonator is about 0.5 MHz, the resonator figure of merit will be ΔF/Δf≈71.5/0.5≈140. It should however be clear that FIGS. 6A,6B,7A,7B,7C merely are included for illustrative and exemplifying purposes.

Figure 8A:
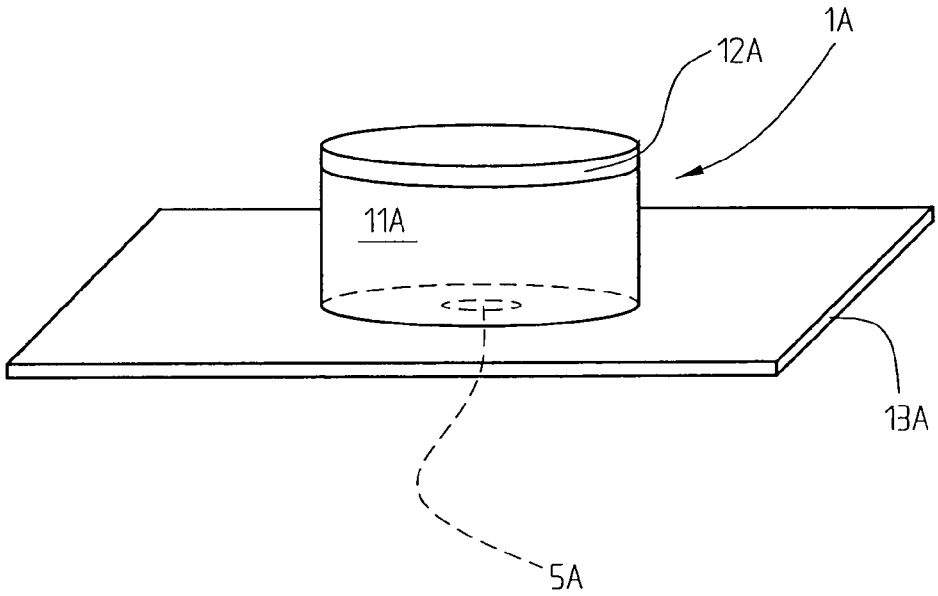

FIG. 8A shows one particular example of a first resonator 1A e.g. as in FIG. 4, which comprises a circular disk resonator. It comprises a non-tunable, high quality linear substrate 11A, a first conducting electrode 12A, which for example may be superconducting or even high temperature superconducting, and a second electrode 13A which for example is a larger than the substrate 11A and the first electrode 12A. It may for example also have the same size as the first electrode 12A. This second electrode plate 13A acts as a common ground plane for the first resonator 1A and for the second resonator 2A of FIG. 8B. The common ground plane 13 comprises coupling means 5A for coupling the first resonator 1A and the second resonator 2A to each other.

The second resonator 2A comprises a first electrode 22A disposed on a ferroelectric substrate e.g. of STO which is non-linear and has an (extremely) high dielectric constant. Biasing means comprising a variable voltage source $V_o$ 3 with connection leads is connected to the common ground plane 13A and to the first electrode plate 22A of the second resonator 2A. Preferably the $TM_{020}$ modes are excited via input coupling means (not shown in this figure). The coupling means 5A may comprise a slot which is circular or ellipsoidal, and through which electromagnetic energy from the second resonator 2A can be redistributed to the first resonator 1A upon application of a biasing voltage to the second resonator 2A.

Figure 8B:
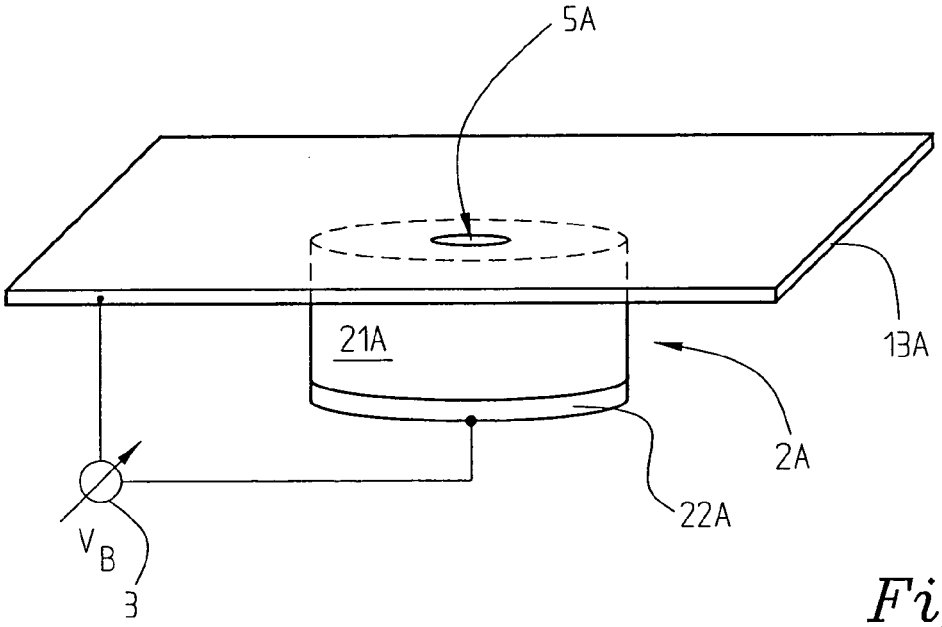
Figure 9A:
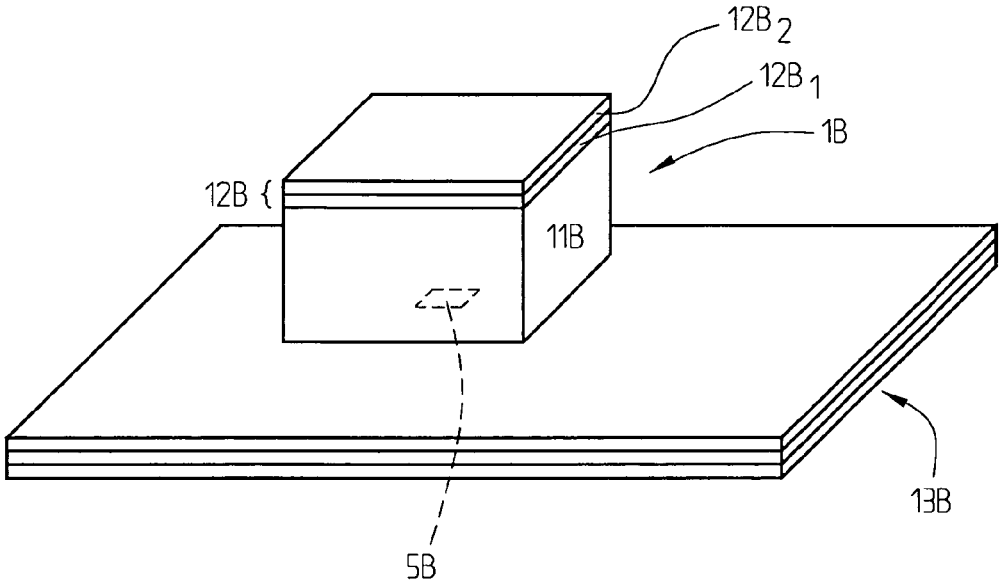
FIG. 9A shows an alternative implementation of a first resonator of a resonator apparatus according to the invention.
Figure 9B:
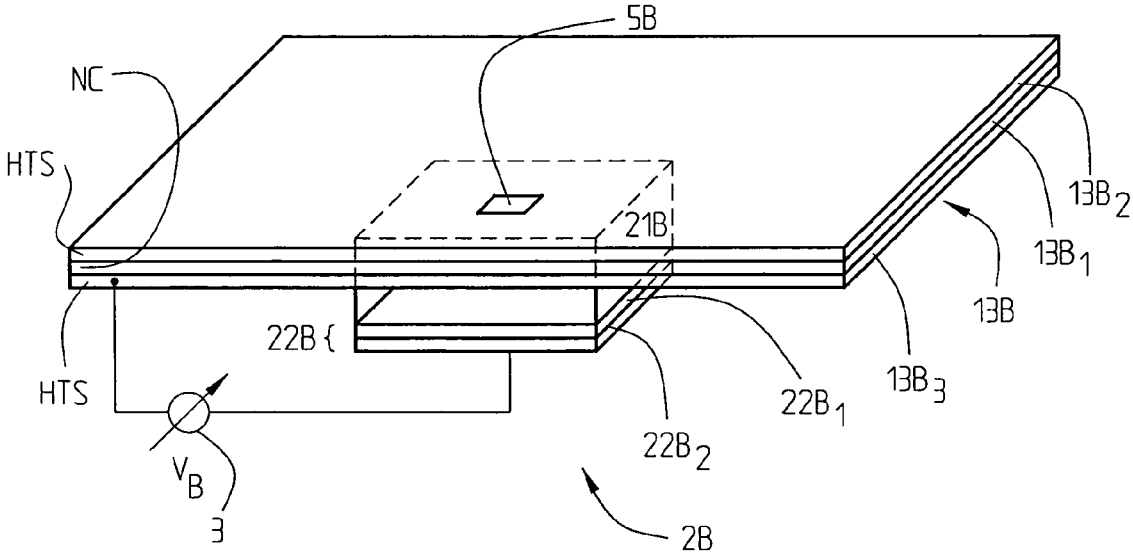
FIG. 9B illustrates an example of a second resonator that can be used with the first resonator of FIG. 9A in a resonator apparatus according to the invention, FIG. 10 very schematically illustrates an example of a dual mode resonator that can be used in a resonator apparatus according to the invention, FIG. 11 schematically illustrates a two-pole filter based on a resonating arrangement according to the present invention.

FIGS. 9A, 9B in a manner similar to that of FIGS. 8A, 8B illustrate a first resonator 1B (FIG. 9A) and a second resonator 2B (FIG. 9B) together forming an alternative resonator apparatus in which the first and second resonators 1B, 2B are square-shaped. The first resonator 1B, like in the preceding embodiment, comprises a linear material with a high quality factor which is non-tunable, e.g. of $LaAlO_3$, and the second resonator 2B comprises a tunable ferroelectric material e.g. of STO. The first resonator 1B comprises a first electrode plate 12B which of course can be similar to the electrode plate of FIG. 8A with the difference that it is square-shaped, but it may also, as illustrated in the figure, comprise a very thin, (thin in order not to affect the surface impedance) superconducting layer 12$B_1$ covered, on the side opposite to the substrate, by a non-superconducting high conductivity film 12$B_2$ e.g. of Au, Ag, Cu or similar for protective purposes. Particularly the superconducting film is high temperature superconducting, e.g. of YBCO.

In a corresponding manner the second resonator 2B comprises a first electrode plate 22B with a (high temperature) superconducting layer 22$B_1$ covered by a non-superconducting metal layer 22$B_2$. The first and second resonator 1B, 2B, like in the preceding embodiment, comprise a common ground plane, for both forming a second electrode 13B which, in this particular implementation, comprises a (high temperature) superconducting layer 13$B_1$ covered on either side by a very thin non-superconducting metal film 13$B_2$, 13$B_3$. Alternatively the ground plane just consists of a superconducting layer. A biasing voltage is applied between the first and second electrodes 22B, 13B of the second resonator 2B and electromagnetic energy can be redistributed via coupling means 5B, which here comprises a rectangular slot, to the first resonator 1B. It should be clear that the coupling means does not have to be a rectangular slot, but it can be any kind of aperture giving the desired properties as far as transfer of electromagnetic energy is concerned for the concerned modes. It may e.g. be circular or ellipsoidal as well. Still further the electrodes may consist of normal metal only.

The inventive concept is also applicable to dual mode operating resonators, oscillators, filters whereby dual mode operation can be provided for in different manners, e.g. as disclosed in the patent application "Tunable Microwave Devices" and U.S. Pat. No. 6,463,308 which was incorporated herein by reference.

Figure 10:
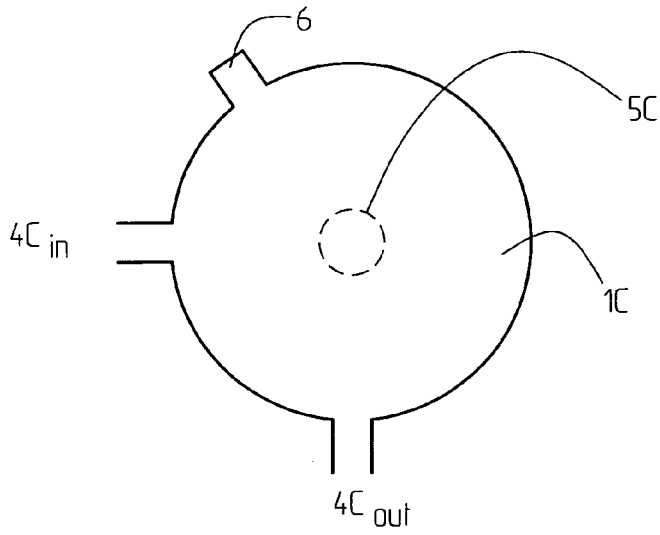

FIG. 10 for illustrative purposes shows a very simplified top view of a dual mode resonator apparatus comprising input 4$C_{in}$ and output 4$C_{out}$ coupling means and a protruding portion 6 for providing coupling enabling dual mode operation. A dual mode operating resonator apparatus can also be provided for by rectangularly shaped resonators or in any other appropriate manner. The coupling slot for coupling between the first and second resonator is illustrated by the dashed line circle.

Figure 11:
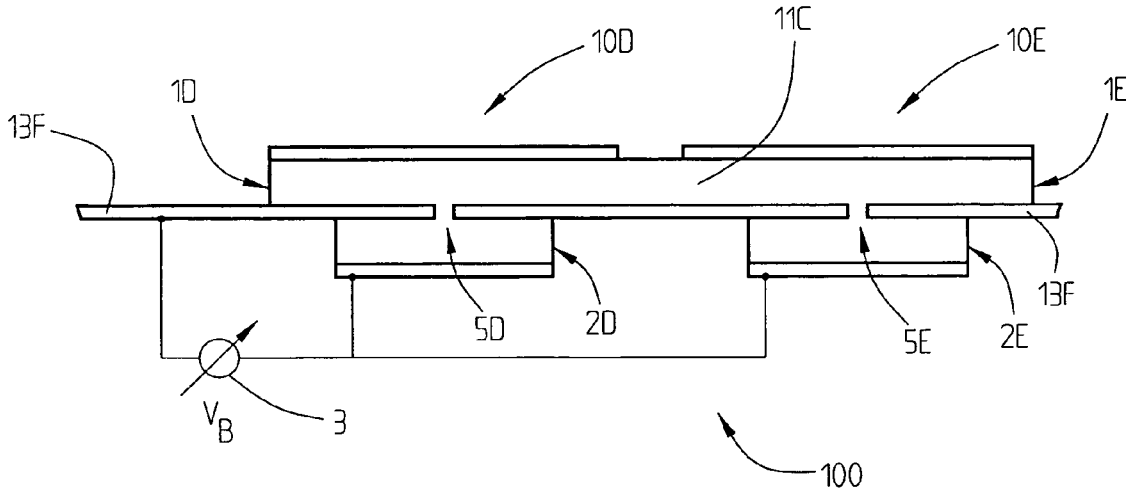

In one implementation the inventive concept is extended to a tunable filter 100 (refer to. FIG. 11). Two resonator apparatuses 10D, 10E are provided each comprising a first resonator 1D, 1E respectively and a second resonator 2D, 2E respectively, which share a common ground plane 13F. In this embodiment the first resonators 1D,1E comprise a common substrate 11C. There may alternatively be separate substrates. The distance between the resonator apparatuses gives the coupling strength of the filter. The resonator apparatuses can comprise circular disk resonators as described in for example FIGS. 4–8 or any other alternative kind of resonators, the main thing being that two resonator apparatuses as discussed herein are used to provide a tunable two-pole filter. Coupling between the resonators of each resonator apparatus is provided by coupling means 5D, 5E. By using tunable disk resonators, the power handling capability will be higher than if thin film resonators are used. The input and output coupling means are not illustrated in this FIG.

Figure 12:
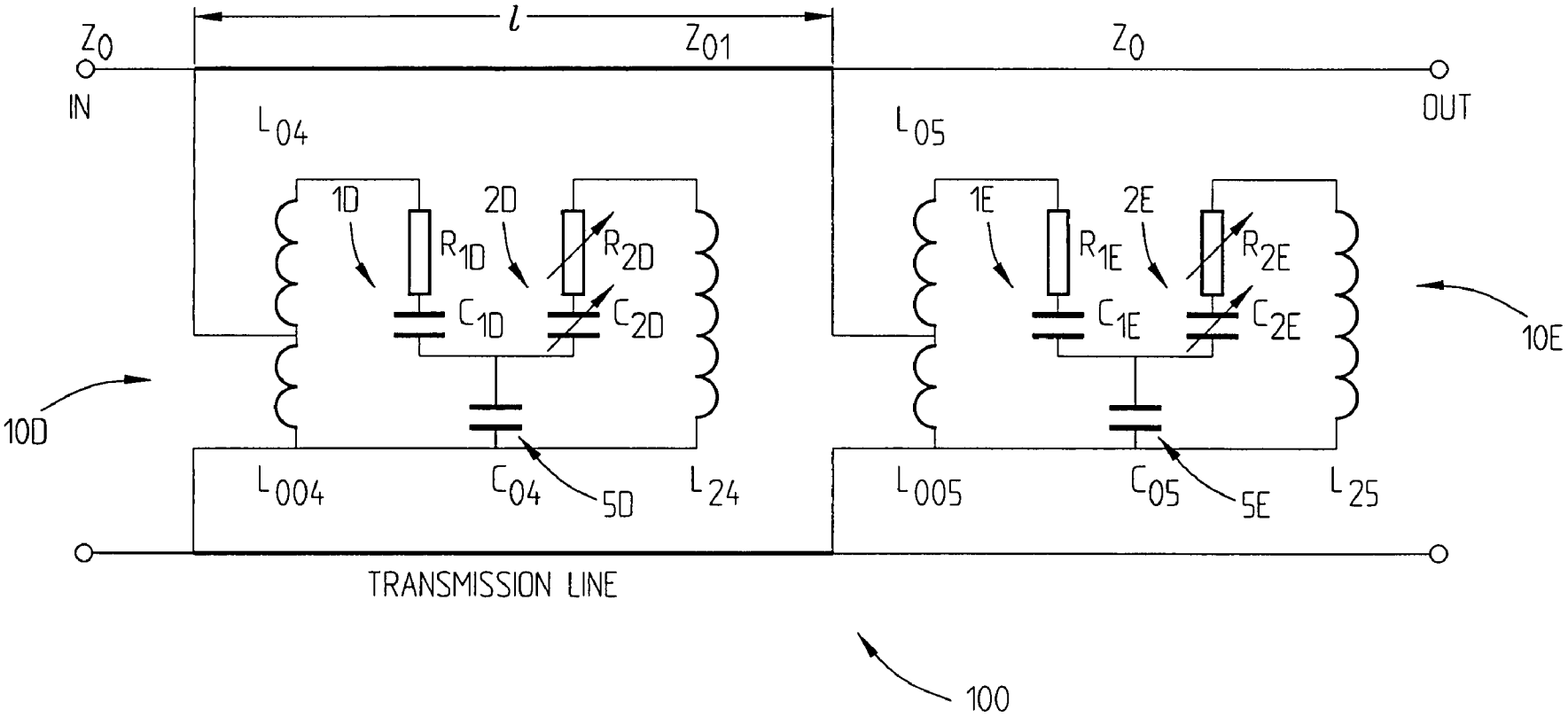
FIG. 12 illustrates the equivalent circuit for the two-pole filter of FIG. 11, FIGS. 13A, 13B illustrate simulated results of the insertion losses and the return losses as functions of the frequency for different values of the biasing voltage for a tunable two-pole filter as in FIG. 11.

FIG. 12 illustrates the equivalent circuit of a two-pole filter 100 as in FIG. 11 which is connected by a transmission line section. In the figure it is illustrated the first resonator apparatus 10D with reactance $R_{1D}$ and capacitance $C_{1D}$ corresponding to the first non-tunable resonator 1D and the tunable resonator 2D comprising a reactance $R_{2D}$ and capacitor $C_{2D}$ which resonators are coupled to each other by the coupling means 5D represented by a capacitor $C_{04}$. The inductances $L_{04}$, $L_{004}$; $L_{05}$, $L_{005}$ of the resonators are also illustrated in the figure as explained earlier with reference to FIG. 6A, 6B, 7A, 7B. To the first resonator apparatus is connected a second resonator apparatus 10E comprising a first resonator 1E and second resonator 2E with the respective non-tunable and tunable components resistance $R_{1E}$, $C_{1E}$ and $R_{2E}$, $C_{2E}$ respectively and connecting capacitor $C_{05}$ corresponding to coupling means 5E. It is supposed that the two-pole filter is connected by a transmission line section. In the exemplifying figure the characteristic impedance of the external line $Z_0$=50 Ohm, the characteristic impedance of the coupling line $Z_{01}$=45 Ohm, and the electrical length of the coupling line at the central frequency is 80°.

Figure 13A:
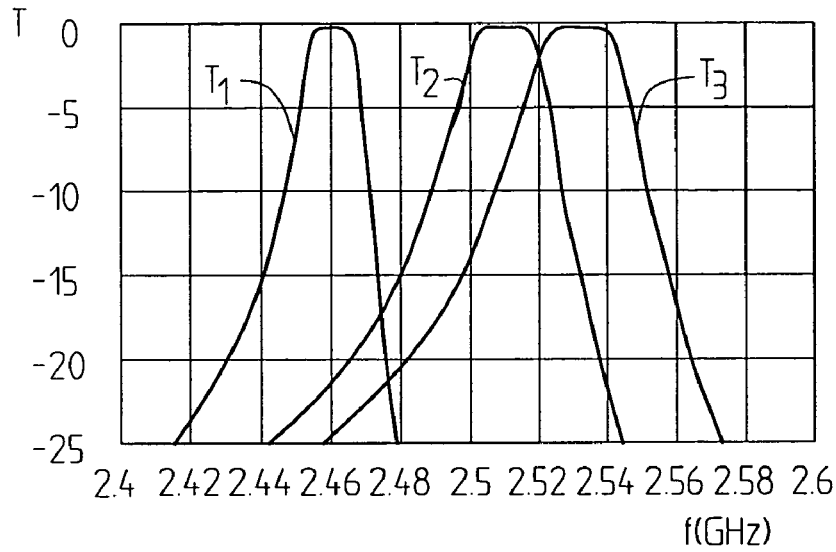
Figure 13B:
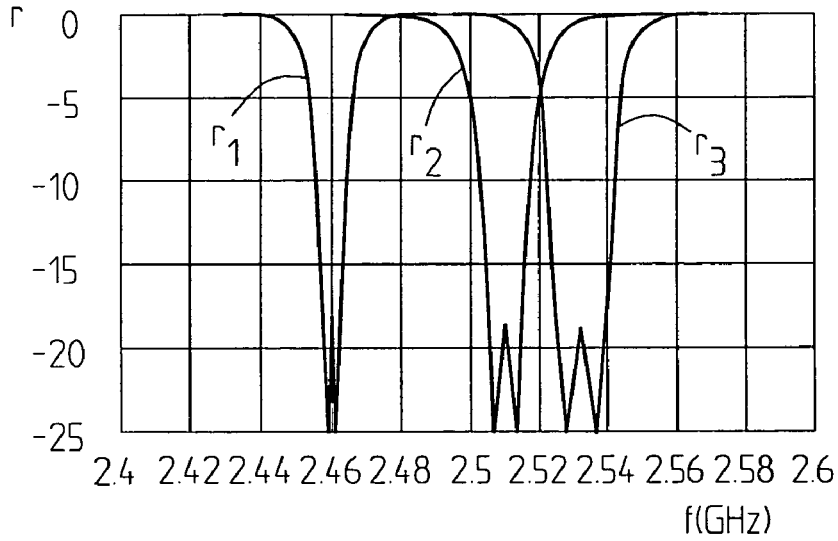

FIGS. 13A, 13B are diagrams showing simulated lines of the tunable two-pole filter of FIG. 10. The insertion losses in dB and the return losses in dB correspond to the transmissions T and the reflectivity. Γ is given for three different values of a biasing voltage V. In FIG. 13A T1 corresponds to the transmission as a function of the frequency at zero biasing voltage, $T_2$ corresponds to the transmission as a function of the frequency in GHz for a biasing voltage of 100V and $T_3$ is the transmission for a biasing voltage of 200V. Correspondingly the reflectivities $\Gamma_1$, $\Gamma_2$, $\Gamma_3$ are indicated in FIG. 13B for biasing voltages 0V, 100V, 200V. As can be seen the insertion losses and the return losses are maintained even at a higher biasing voltage. The average bandwidth is 15 MHz, and the range of tunability is approximately 70 MHz with an insertion loss ~0.5 dB. The drastically increasing loss factor of the ferroelectric material of the second resonator is largely compensated for through the application of the inventive concept.

It should be clear that the inventive concept can be varied in a number of ways without departing from the scope of the appended claims. Particularly the resonators may be of other different shapes, they may comprise different substrate materials as discussed in the foregoing, they may comprise non-superconducting or particularly (high temperature) superconducting electrodes etc. They may also be single mode operating or dual mode operating and any appropriate type of coupling means may be provided for coupling in of electromagnetic energy to excite the desired modes, i.e. the modes which are selected, particularly the $TM_{020}$ modes. However, also other modes can be selected in any appropriate manner.

It is also possible to use the concept for building different types of filters, band pass filters as well as band reject filters etc.

The invention claimed is:

1. A tunable resonating arrangement comprising:
- a resonator apparatus,
- input/output coupling means for coupling electromagnetic energy into/out of the resonator apparatus,
- a tuning device for application of a biasing voltage/electric field to the resonator apparatus,
- wherein the resonator apparatus comprises:
  - a first resonator,
  - a second resonator,
  - wherein said first resonator is non-tunable,
  - wherein said second resonator is tunable and comprises a ferroelectric substrate,
  - wherein the first resonator and the second resonator work as a single resonator,
  - a ground plane for separating said first and second resonators, the ground plane being common for said first and second resonators,
  - coupling means for coupling said first and second resonators,
  - wherein for tuning of the resonator apparatus, the biasing voltage/electric field is applied to the second resonator.

2. A tunable resonating arrangement according to claim 1, wherein the first resonator is a disk resonator or a parallel plate resonator.

3. A tunable resonating arrangement according to claim 1, wherein the second resonator is a disk resonator or a parallel plate resonator.

4. A tunable resonating arrangement according to claim 2, wherein the first resonator comprises a dielectric substrate, the electric permittivity of which substantially does not vary with biasing voltage applied to the second resonator, which is disposed between a first resonator first electrode and a first resonator second electrode, and in that the first resonator second electrode forms the ground plane.

5. A tunable resonating arrangement according to claim 4, wherein the dielectric substrate of the first resonator comprises $LaAlO_3$, MgO, $NdGaO_3$, $Al_2O_3$, or sapphire.

6. A tunable resonating arrangement according to claim 4, wherein the first resonator has a high quality factor (Q) which is approximately $10^5$ to $5 \cdot 10^5$.

7. A tunable resonating arrangement according to claim 4, wherein the second resonator comprises a tunable ferroelectric substrate, a second resonator first electrode, and a second resonator second electrode, and in that the second resonator second electrode also forms the common ground plane, and thus the second resonator second electrode also is the first resonator second electrode.

8. A tunable resonating arrangement according to claim 7, wherein the ferroelectric substrate of the second resonator comprises $SrTiO_3$, $KTaO_3$, or $BaSTO_3$.

9. A tunable resonating arrangement according to claim 4, wherein the first and second electrodes comprise a non-superconducting metal.

10. A tunable resonating arrangement according to claim 4, wherein the first and second electrodes comprise a superconducting material.

11. A tunable resonating arrangement according to claim 4, wherein the first and second electrodes comprise a high temperature superconducting material.

12. A tunable resonating arrangement according to claim 1, wherein upon application of a biasing voltage to said second resonator, electromagnetic energy is redistributed between the second and first resonators via the coupling means.

13. A tunable resonating arrangement according to claim 12, wherein the redistribution of electromagnetic energy is a function of the biasing voltage.

14. A tunable resonating arrangement according to claim 13, wherein the redistribution of electromagnetic energy from the second resonator to the first resonator increases with an increasing biasing voltage.

15. A tunable resonating arrangement according to claim 14, wherein the resonating frequency and the loss tangent of the second resonator increase with application of an increasing biasing voltage, and wherein the redistribution of electromagnetic energy from the second to the first resonator is increased, automatically compensating for the increased loss tangent of the second resonator by reducing influence thereof on the coupled resonator apparatus.

16. A tunable resonating arrangement according to claim 1, wherein the first and second resonators comprise respective thin film substrates.

17. A tunable resonating arrangement according to claim 1, further comprising at least two resonator apparatuses, and in that the common ground plane is common for the at least two resonator apparatuses which form a tunable filter.

18. A tunable resonating arrangement according to claim 1, wherein the coupling means comprises, for the resonator apparatus, a slot or an aperture in the common ground plane.

19. A tunable resonating arrangement according to claim 1, wherein the resonator is circular, square shaped, rectangular or ellipsoidal.

20. A tunable resonating arrangement according to claim 19, wherein the arrangement comprises a dual mode resonator apparatus, and wherein the resonator comprises a protrusion, a cut-out, or a pertubation to provide for dual mode operation.

21. A tunable resonating arrangement according to claim 1, wherein the resonator apparatus provides a two pole filter.

22. A tunable resonator apparatus comprising:

a first resonator;

a second resonator;

said first resonator being non-tunable; said second resonator being a tunable ferroelectric resonator;

wherein the first resonator and the second resonator work as a single resonator;

a ground plane for separating said first and second resonators, the ground plane being common for said first and second resonators;

coupling means for providing coupling between said first resonator and said second resonator; and wherein for tuning of the resonator apparatus, a biasing voltage is applied to the second resonator.

23. A tunable resonator apparatus according to claim 22, wherein the first resonator and the second resonator comprise respective parallel plate resonators, that the common ground plane is formed by a second electrode plate of the first resonator and of a second electrode plate of the second resonator, and wherein the coupling means comprises a slot or an aperture in the common ground plane.

24. A tunable resonator apparatus according to claim 23, wherein the first resonator comprises a substrate comprised of $LaAlO_3$, MgO, $NdGaO_3$, $Al_2O_3$, or sapphire, wherein the second resonator comprises a substrate comprised of $SrTiO_3$, or $KTaO_3$, wherein the second electrode plate of the first resonator and the second electrode plate of the second resonator comprise normal metal, or high temperature superconductors.

25. A method of tuning a resonator apparatus, comprising:

providing a first, non-tunable, resonator, providing a second tunable resonator, separating the first and second resonators by a common ground plane, providing coupling means in said common ground plane such that the first and second resonators becomes a coupled resonator apparatus, thereby allowing transfer of electromagnetic energy between the first and second resonators, applying a biasing/tuning voltage to said second resonator for changing the resonating frequency, and the loss tangent of the second resonator, and the transfer of electromagnetic energy to the first resonator, optimizing application of the biasing voltage such that influence of the increased loss tangent in the first resonator, on the coupled resonator apparatus, will be compensated for, by an increased transfer of electromagnetic energy to the first resonator.

26. The method of claim 25, wherein the first resonator and the second resonator comprise disk or parallel plate resonators, wherein the common ground plane is formed by a second electrode plate of the first resonator and of a second electrode of the second resonator, and wherein the coupling means comprises a slot or an aperture in the common ground plane.

27. The method of claim 25, wherein the first resonator comprises a substrate comprised of $LaAlO_3$, MgO, $NdGaO_3$, $Al_2O_3$, or sapphire, wherein the second resonator comprises a substrate comprised of $SrTiO_3$, or $KTaO_3$, wherein electrode plates of the first and second resonators comprise normal metal, or high temperature superconductors.

28. The method of claim 27, further comprising:

coupling two or more resonator apparatuses such that a filter is provided, optimizing the coupling between the respective first and second resonator such that the increasing loss factor produced by an increased biasing voltage is reduced.

29. A tunable resonating arrangement according to claim 22, wherein the resonator apparatus provides a two pole filter.

* * * * *